US011585211B2

(12) United States Patent
Keller

(10) Patent No.: US 11,585,211 B2
(45) Date of Patent: Feb. 21, 2023

(54) FLEXIBLE LINER SYSTEM AND METHOD FOR DETECTING FLOWING FRACTURES IN MEDIA

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 63 days.

(21) Appl. No.: 17/116,709

(22) Filed: Dec. 9, 2020

(65) Prior Publication Data

US 2021/0172314 A1 Jun. 10, 2021

Related U.S. Application Data

(60) Provisional application No. 62/945,645, filed on Dec. 9, 2019.

(51) Int. Cl.
*E21B 47/11* (2012.01)
*E21B 43/08* (2006.01)

(52) U.S. Cl.
CPC ..... *E21B 47/11* (2020.05); *E21B 43/08* (2013.01)

(58) Field of Classification Search
CPC ..... E21B 47/11; E21B 47/10; E21B 47/113; E21B 47/114; E21B 43/08; E21B 43/082; E21B 43/084; E21B 43/086; E21B 43/088; E21B 43/10; E21B 43/103
See application file for complete search history.

(56) References Cited

U.S. PATENT DOCUMENTS 4,778,553 A 10/1988 Wood
5,176,207 A 1/1993 Keller
5,246,862 A 9/1993 Grey et al.
5,377,754 A 1/1995 Keller
5,725,055 A 3/1998 Schirmer
5,803,666 A 9/1998 Keller
5,804,743 A 9/1998 Vroblesky et al.
5,853,049 A 12/1998 Keller
6,026,900 A 2/2000 Keller
6,109,828 A 8/2000 Keller
6,244,846 B1 6/2001 Keller
6,283,209 B1 9/2001 Keller
(Continued)

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.
(Continued)

*Primary Examiner* — Angela M DiTrani Leff
(74) *Attorney, Agent, or Firm* — Rod D. Baker

(57) ABSTRACT

A method and system using the measured adsorption of a tracer substance leached from a flexible liner sealing a subterranean borehole to indicate the flow of fluid, typically water, past the borehole. The liner is provided with contaminant collectors. The liner is impregnated in its fabrication with a tracer substance. The tracer is leached from the liner as water flows past the liner in/from fractures in the surrounding geologic formation. The water containing any leached tracer may also flow past the collectors. The collectors adsorb the tracer relative to the amount of tracer leached from the liner and into the passing water, and the concentration of tracer in the flowing water is proportional to the amount of toluene leached from the liner. The tracer level in a collector is tested as an indication of the flow past the liner.

14 Claims, 4 Drawing Sheets

(56) References Cited

U.S. PATENT DOCUMENTS

| | | | | |
|---|---|---|---|---|
| 6,910,374 | B2 | 6/2005 | Keller | |
| 7,281,422 | B2 | 10/2007 | Keller | |
| 7,334,486 | B1 * | 2/2008 | Klammler | G01F 1/74 73/861.07 |
| 7,753,120 | B2 | 7/2010 | Keller | |
| 7,841,405 | B2 | 11/2010 | Keller | |
| 7,896,578 | B2 * | 3/2011 | Keller | F16L 55/1651 436/25 |
| 8,069,715 | B2 | 12/2011 | Keller | |
| 8,176,977 | B2 | 5/2012 | Keller | |
| 8,424,377 | B2 | 4/2013 | Keller | |
| 9,008,971 | B2 | 4/2015 | Keller | |
| 9,534,477 | B2 | 1/2017 | Keller | |
| 9,797,227 | B2 | 10/2017 | Keller | |
| 10,030,486 | B1 | 7/2018 | Keller | |
| 10,060,252 | B1 | 8/2018 | Keller | |
| 10,139,262 | B2 | 11/2018 | Keller | |
| 10,337,314 | B2 | 7/2019 | Keller | |
| 10,472,931 | B1 | 11/2019 | Keller | |
| 2005/0235757 | A1 * | 10/2005 | De Jonge | G01F 1/704 73/61.72 |
| 2008/0142214 | A1 * | 6/2008 | Keller | E21B 43/08 166/100 |
| 2011/0257887 | A1 * | 10/2011 | Cooper | E21B 47/11 702/12 |
| 2020/0232292 | A1 | 7/2020 | Keller | |
| 2020/0386082 | A1 | 12/2020 | Keller | |

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner

FLEXIBLE LINER SYSTEM AND METHOD FOR DETECTING FLOWING FRACTURES IN MEDIA

CROSS-REFERENCE TO RELATED APPLICATIONS

This application claims the benefit of U.S. Provisional Patent Application Ser. No. 62/945,645 entitled "Method for Detection of Flowing Fractures," filed on 9 Dec. 2019, the entire disclosure of which is hereby incorporated by reference.

BACKGROUND OF THE INVENTION

Field of the Invention

This invention relates to the mapping of relative fluid flow rates in fractures in subsurface geologic media, and particularly to the use of flexible borehole liners and sampling systems for evaluation of such flow rates, and specifically to the measured adsorption of a tracer composition leached from a flexible liner to indicate the flow and flow direction of water past the liner.

Background Art

Everting flexible liners are used for a wide variety of underground measurements, as described in a variety of my previous patents, including U.S. Pat. Nos. 5,176,207, 6,283,209, 6,910,374, 7,896,578, and 10,337,314—which are incorporated herein by reference. One method uses an activated carbon felt strip to adsorb dissolved contaminants in the pore space and fractures of a subsurface geologic formation. Another method uses the temperature change attributed to ground water flows in a borehole sealed with a flexible liner. A third method uses the measurement of a brine injection to deduce the flow rate and direction of flow in an open borehole. An early method used the introduction of a heat pulse that is then mapped by the heated water flow past an array of thermal detectors.

Another known system, disclosed in U.S. Pat. No. 7,334,486 to Klammler, et al., sometimes called a "flux meter," uses a full surround carbon cover on the entirety of a borehole liner, and a dye impregnated in the carbon cover, to map fractures by detecting the removal of the dye due to the flow of fluid (e.g., groundwater) past the carbon covering. The full carbon covering is analyzed for contaminants. And my system and method disclosed in U.S. Pat. No. 6,910,374, uses an everting flexible liner to map the conductive paths intersecting a borehole and to measure the flow capacity of those flow paths. The transmissivity of subterranean formations can be measured by the transmissivity profile method of my U.S. Pat. Nos. 6,910,374 and 7,281,422).

The technique revealed in the '486 patent to Klammler et al. merits additional comment. Klammler does not employ an everting/inverting liner for installation and removal. Further, the dye pattern in Klammler's dyed carbon system is used to determine fracture orientation, not as a tracer to be collected in the carbon. (The basic concept and function of a contaminant absorber on a borehole liner was described in my early U.S. Pat. No. 5,176,207.) Klammler detects fractures by dye erosion, whereas the method disclosed hereinafter monitors flow rates by collection over time, and subsequent measurement, of a tracer leached from the liner. Klammler accordingly does not define flow rates or flow capacity; he purports to evaluate flux by the amount of contaminant adsorbed in the carbon (which is not directly dependent on the quantity of contaminant passing by).

So, in the techniques of Klammler, there is no tracer whose absorption is directly equivalent to the tracer leached from the liner itself and then absorbed for analysis. Once the Klammler dye has been eroded from the carbon exposed, the measurement is ended with no measure of subsequent flow or rates. By such a method, Klammler proposes to detect fracture orientation from a complex system difficult to manufacture, and contaminants from the absorbed contaminants. Since absorption on a felt absorber situated on an inflated liner is long known in the art, a principal result in Klammler's technique is fracture orientation and identifying flow in the fracture. But the flow indication is by dye erosion, not tracer absorption.

Finally, Klammler lowers his system down-hole while it is enclosed in a pipe, and the pipe is then removed to avoid excessive contact with the borehole wall or water. However, after the commencement of the pipe removal, the detection system remains exposed until the pipe is fully removed and the liner fully inflated. An even longer exposure occurs while the liner is sufficiently deflated to allow the system to be lifted from the borehole for analysis. Both these undesirable exposures are avoided by a distinguishable system in which an everting liner exposes the carbon felt absorbers for only a few seconds during eversion or inversion into position against the borehole wall.

Currently known everting flexible liners are installed for a variety of measurements, but more often specifically to seal a borehole. Everted sealing liners are frequently equipped with an adsorbent activated carbon felt strip (such as the system seen in U.S. Pat. No. 7,896,578) which collects the dissolved phase of contaminants in the pore space and fractures of an adjacent geologic medium. After contaminant collection, the liner is inverted to withdraw it from the borehole, and the single carbon strip is divided into equal lengths and analyzed to determine the distribution of contaminants in the nearby formation. Yet many known fracture flow measurement systems which employ an everting liner (e.g., U.S. Pat. Nos. 6,910,374 and 7,281,422) do not distinguish naturally flowing fractures from those not currently flowing under natural conditions. And U.S. Pat. No. 7,896,578 does not provide any information on the direction of the flow.

Against the foregoing background, the present invention was developed.

SUMMARY OF THE INVENTION

The present invention uses the measured adsorption of a tracer, typically toluene, leached from a flexible liner everted into a borehole to indicate the flow of water past the liner sealing the borehole. The liner is provided with contaminant collectors, preferably three in number and in the form of carbon felt strips. Because a flexible liner according to this system and method is uniformly impregnated with toluene in its fabrication, the toluene is leached from the liner as water flows past the liner in/from the surrounding geologic formation. The water containing any leached toluene may also flow past the carbon felt detectors. The detectors' carbon adsorbs the toluene relative to the amount of toluene leached from the liner and into the passing water.

Consequently, the concentration of toluene in the flowing water is proportional to the amount of toluene leached from the liner. The toluene level in the carbon therefore can be tested (e.g., after the liner is withdrawn from the borehole)

as an indication of the water flow past the liner (and past the carbon felt strips). However, the amount of toluene in a given carbon felt strip depends, in part, upon the location of the strip on the liner. The present system and method allow the amount of toluene tracer adsorbed, which is extracted from the several (ordinarily three) carbon strips, to be relatively independent of the location of any particular carbon collector's radial position on the liner—and thus to be a more reliable measure of the total relative flow past the liner. This methodology permits a reasonable estimate of the relative natural flow in adjacent fractures. The present method also allows an estimate of the direction of flow in the fracture.

The foregoing summary is offered as a general characterization, and is not to be construed as limiting of the invention.

BRIEF DESCRIPTION OF THE DRAWINGS

The attached drawings, which form part of this disclosure, are as follows.

The figures are not necessarily to scale, either within a given view or between figures.

DETAILED DISCLOSURE OF THE INVENTION

There is provided according to this disclosure an improved, and comparatively simple, method and system for detecting and evaluating fluid flow in/from fractures in geologic media adjacent a subterranean borehole. The fluid normally is water (typically ground water) with various substances, including contaminants, dissolved or suspended therein. A flexible liner is installed, as by known eversion techniques, into the borehole thereby to seal (temporarily) the borehole. A feature of the present method is the designed addition of several activated carbon felt strips to the flexible liner. The number of strips (preferably three) and their locations upon the liner, promote an improved determination of fluid flow in fractures in the subsurface media surrounding the borehole.

Figure 1:
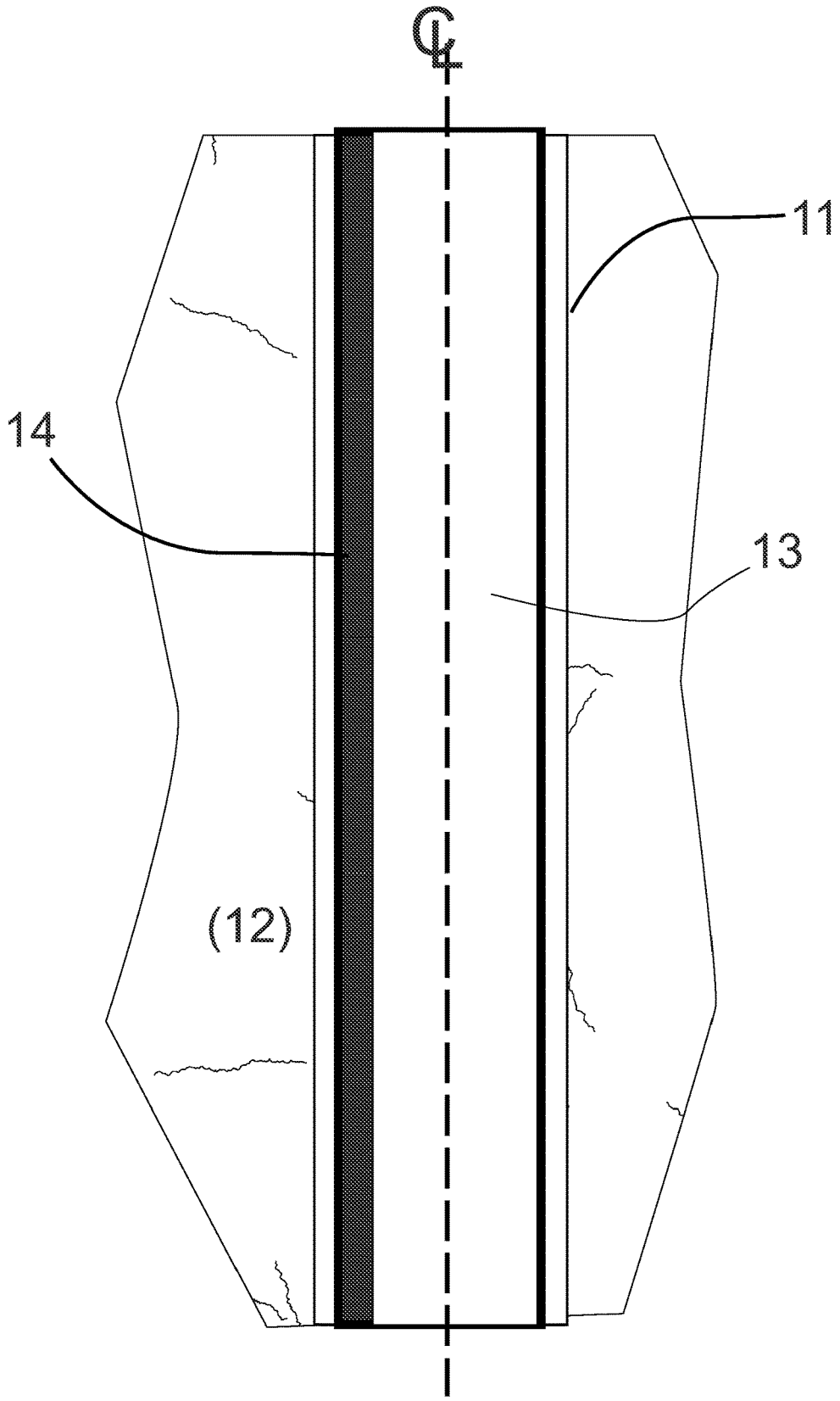
FIG. 1 is a side view in partial vertical section of a system according to the present invention, showing a carbon felt attached to the exterior of a borehole flexible liner in place in a borehole.

Attention is invited to FIG. 1, showing a usual location of a substance detection strip, typically a carbon felt strip 14, attached inside a cover surrounding a tubular flexible liner 13 as emplaced, preferably by eversion, in a borehole 11 in a subsurface geologic formation 12. A cover 22 (not shown in FIG. 1 but seen in FIG. 2) protects the liner 13 from mechanical damage during eversion and use, and is generally permeable to flowing water. Ordinarily, the carbon felt strip 14, while defining an arc subtending only a minor fraction of the tubular liner's circumference, extends along the longitude of the liner the full length (i.e., depth) of the borehole 11. It may be desired by the system and method to identify and evaluate the level of contaminants in water-filled fractures in the surrounding formation 12; the water flows in the fractures, and knowledge of the flow volume discharge and direction likewise is desired.

Figure 2:
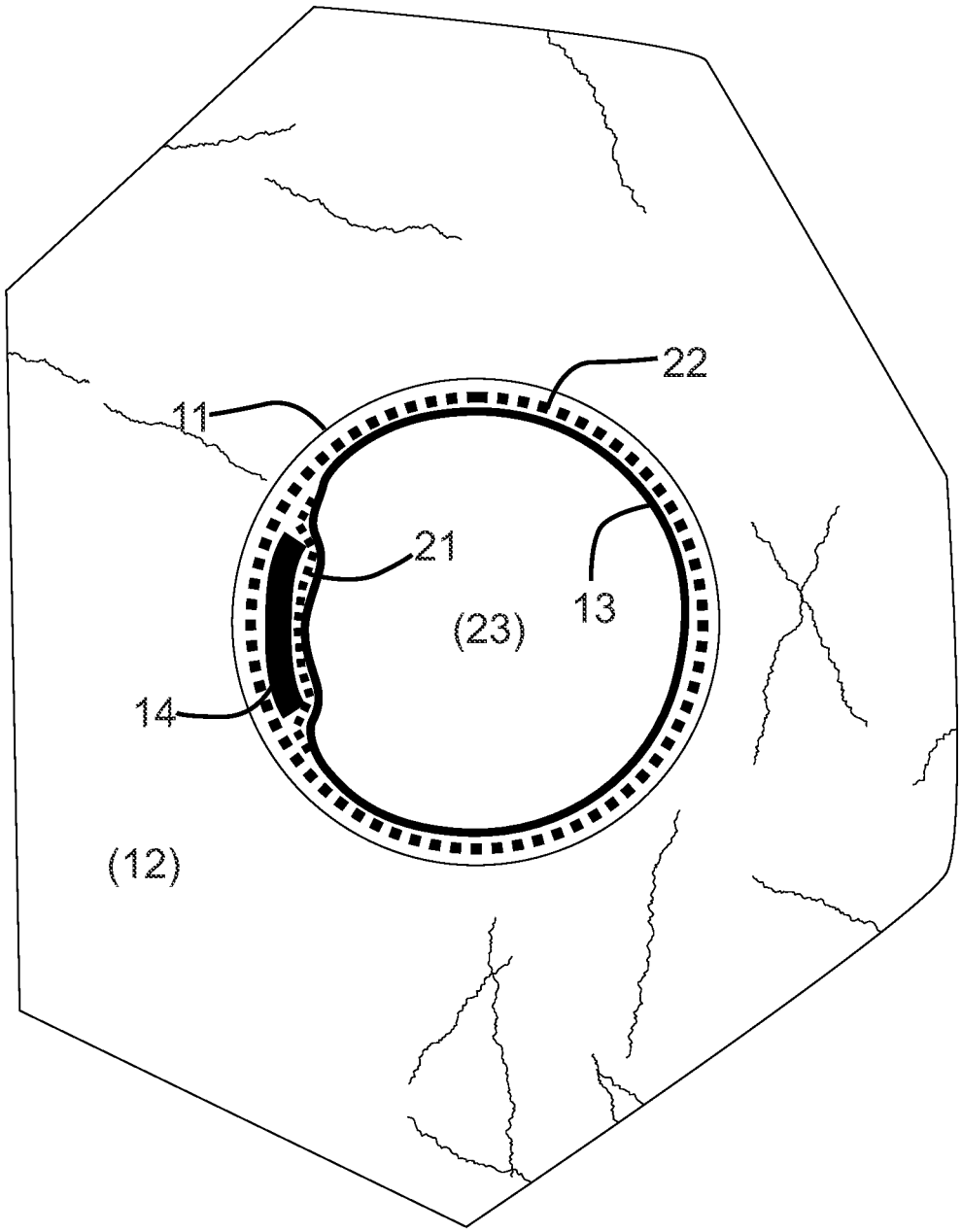
FIG. 2 is a transverse (radial) cross section view of a flexible liner within a subsurface borehole, illustrating a permeable covering for the liner, a carbon felt strip, and a diffusion barrier arranged with the liner.

Referring also to FIG. 2, the substance detection strip 14, e.g., a carbon felt strip, is usually attached to the inside surface of a liner cover 22 at the time of liner 13 fabrication, and is isolated from the liner by a diffusion barrier 21 situated between the felt strip and the liner wall. In such a geometry and configuration, after the liner 13 has been everted (turned "inside out"), the carbon felt strip 14 is disposed between the liner and the borehole wall; the felt strip 14 there adsorbs contaminants primarily from the formation 12 in contact with, or nearly adjacent, the water-permeable liner cover 22 at the circumferential location of the vertically arranged felt strip. However, any fluid flowing toward and past the liner 13 generally horizontally and roughly tangentially to the circumference of the liner can also expose the carbon felt strip 14 to chemicals dissolved in the fluid passing the liner, but not necessarily originating from the formation 12 radially aligned alongside the carbon felt strip 14. Such tangentially or circumferentially flowing water passing by the liner 13 can leach from the liner certain compounds impregnated in the liner originally at the time of liner manufacture. Providing a flexible eversion liner often means that the liner is impregnated with toluene at, and as a consequence of, its fabrication. These compounds, if they (such as toluene) are leachable from the liner by passing ground water, can be exploited as tracer substance(s) according to the present system and method. Such substances originally impregnated in the liner 13 are prevented by the diffusion barrier 21 from moving directly radially outward from the liner 13 and into the carbon felt detection strip 14. The quantity of leached compounds in the passing water flow normally depends on how long the water was exposed to the circumference of the cover 22 and liner 13. Notably, volatile substances such as toluene readily diffuse from the liner 13 outward through the permeable cover 22. If the horizontal water flow in a subsurface formation fracture were perpendicular toward the liner surface (i.e., radially inward toward the borehole axis), and thus directly against the carbon felt strip 14, no significant amount of leachate from the liner 13 itself would be adsorbed to the carbon felt strip by diffusion through the permeable cover 22. (Such a flow would pass through the cover 22 directly to the felt strip 14, while the diffusion barrier 21 remains behind the felt strip detector, between it and the liner 13. However, if the lateral water flow past the liner 13 is exposed to a substantial segment (not covered by a diffusion barrier) of the liner's circumference before contacting the carbon felt strip 14, the diffusion barrier 21 does not prevent adsorption into the carbon felt strip 14 of liner leachate(s) in the passing water.

Therefore, by the system configured as seen in FIG. 2, the mass of compounds leached from the liner 13, for example toluene which is normally in the liner fabric, depends significantly upon the direction of the water flow against and past the liner 13. (Because the cover 22 is permeable, any circumferential flow along and past the cover 22 is exposed to diffusion from the liner 13; accordingly, the effect of the cover 22 upon leaching occurring radially directly outward from the liner can be ignored for purposes of the present disclosure.) Most of the lateral water flow occurs in fractures or permeable beds in the formation 12.

Figure 3:
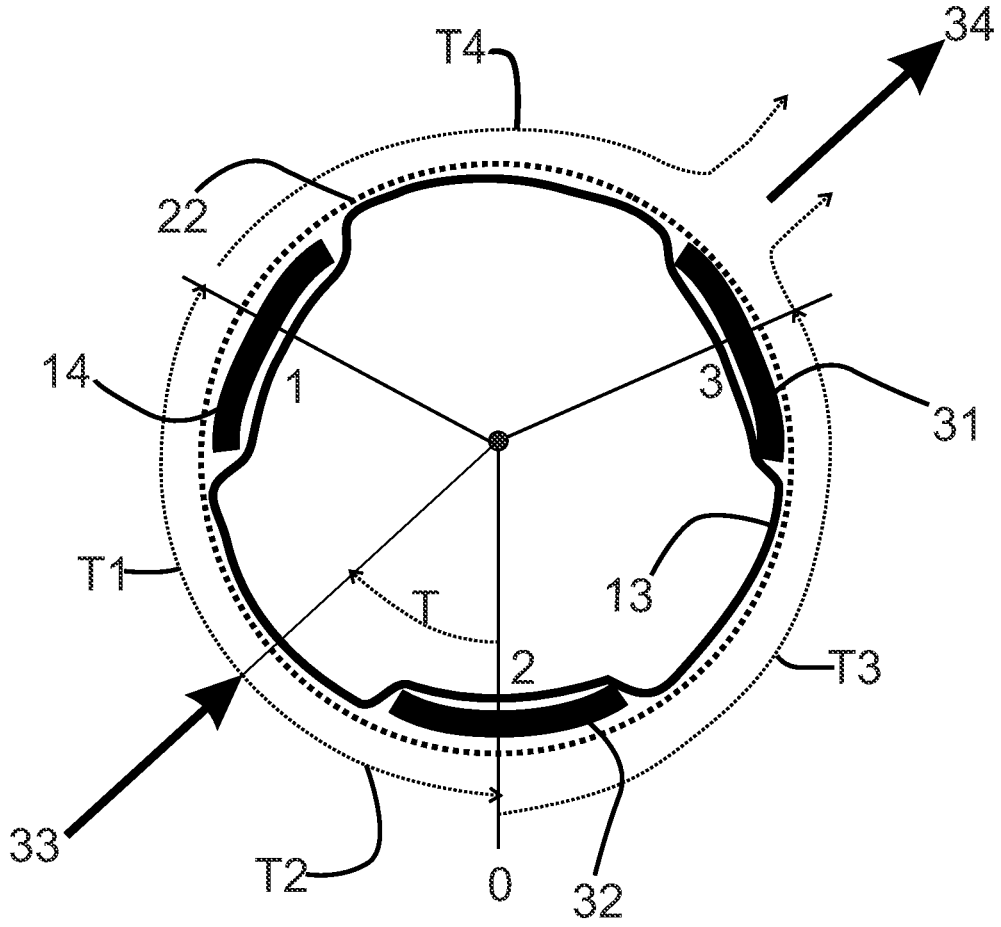
FIG. 3 is a transverse (radial) cross sectional view of a system according to the present invention, illustrating additional carbon felt strips disposed on the liner and the fluid flow paths around the liner and the carbon felt strips.

FIG. 3 illustrates aspects and features of the present system and method. FIG. 3 describes flow paths of a fluid flow encountering a lined borehole as the fluid (typically ground water) flows to the borehole from a fracture in the adjacent geologic formation (formation 12 in FIGS. 1 and 2). The view of FIG. 3 is sectional, taken in the horizontal plane of a subsurface fracture; the liner and surrounding subterranean media are omitted for clarity of illustration. In previously known systems, there may be a single carbon felt strip 14 provided along at least a major portion of the length of the liner 13, and at one azimuthal location on the liner circumference. A preferred embodiment of the presently disclosed system includes the provision of two additional detection strips, namely and preferably, a second carbon felt strip 32 and third felt strip 31, in additional to the first carbon felt strip 14. Although not shown in FIG. 3 for the sake of illustrative simplicity, each of the carbon felt strips 14, 31, 32 has an associated diffusion barrier attached to the permeable cover 22 adjacent to the corresponding felt strip, in the manner disclosed by FIG. 2. An object and advantage of the present system is to avoid the carbon strips' (14, 32, 31) combined total adsorption being sensitive to the direction of the lateral flow of ambient fluid flows, as mentioned hereinabove.

In FIG. 3, the direction of a lateral flow directly toward the borehole 11 is depicted diagrammatically by an original lateral flow vector 33. The original lateral flow 33, upon reaching the borehole sealed by the liner 13, is divided by the presence of the lined borehole. A first portion of the lateral flow travels clockwise around the borehole (i.e., to the left side of the liner 13, from lateral flow vector 33, as seen in FIG. 3), and a second portion of the divided flow travels counterclockwise to the right of the liner 13. Upon reaching the far side of the sealed borehole (diametrically opposite the original impinging flow vector 33), the two divided flows converge as second flow vector 34. In this configuration, each carbon strip 14, 31, 32 has a different exposure to leaching of compounds from the liner 13, because the fraction of the liner 13 circumference traversed by the circumferential flow from the original flow vector 33 to each respective adsorbing felt strip 14, 32, 31 is different.

FIG. 3 thus shows a hypothetical flow in/from a nearby geologic fracture (not shown) as it encounters the lined borehole and flows circumferentially past the liner 13 to the several carbon felt strips 14, 31, and 32. The arrangement seen in the figure is by way of example only, but serves to disclose basic principles of the invention.

The initial undivided lateral flow 33 in the fracture impinges the permeable cover 22 surrounding the liner 13 at an angular azimuthal position defined by an angle T measured from a reference datum labeled 0 in FIG. 3. The lateral flow is then divided. As the first portion of the lateral flow then is forced to travel (clockwise in FIG. 3) around the lined borehole, it traverses a first angular portion of the liner 13, the liner first portion subtending an angle T1. Angle T1 extends from the original lateral flow vector 33 to the first felt strip adsorber 14 position, labeled position 1. Thus, T1 in FIG. 3 defines the angular position, on the liner 13, of the first felt strip adsorber 14 in relation from the first flow vector's encounter with the liner 13 at the position angle T. Similarly, as the second portion of the lateral flow moves counterclockwise circumferentially around the borehole, it traverses a second angular portion of the liner 13, the second portion subtending an angle T2. Angle T2 extends from the lateral flow vector 33 to the second felt strip adsorber 32 position, labeled position 2. And, as that second portion of the lateral flow continues to move counterclockwise farther around the borehole, it also traverses a third angular portion subtending a third angle T3. Angle T3 extends from reference datum 0 to the third felt strip adsorber 31, at labeled position 3.

The first flow travel clockwise along the liner periphery, from the impingement point of the original flow vector 33 to the first position 1, thus has a circumferential flow path given by angle T1. The curvilinear length L1 of such path is measured as:

$$L1=\pi D\ (T1)/360 \text{ degrees}$$

where D is the diameter of the liner 13 and T1 is given in units of degrees. Likewise, any second flow deflected counterclockwise around the right side of the lined borehole is exposed to the liner 13 for a distance L2=πD(T2)/360 before reaching the second felt strip adsorber 32. And another portion of the flow toward the third carbon felt strip 31 has a flow path length along the liner that is distance L3=πD (T3)/360 to reach that third adsorber felt strip. (Again, it is noted that third angle T3 is measured from the reference datum 0 in FIG. 3.) An important simplifying assumption is that any water flowing past the second felt strip 32 is depleted of liner leachate, as the flow moves past the adsorbing second felt strip 32. It also may be assumed that counterclockwise flow after the second felt strip 32 at position 2, and on to third felt strip 31 at position 3, gains leachate mainly from the third liner portion beyond the second felt strip 32. (The clockwise flow after the first felt strip 14 at position 1, and on toward the third felt strip 31 at position 3, may gain leachate from the liner portion subtending angle T4 beyond the second felt strip 31.) As the water flows past the liner 13 for the lengths L1, L2, and L3, the toluene in the liner can be leached to mingle with the water flow in proportion to how long the flow is exposed to the liner. The circumferential flow velocity around the borehole is assumed to be approximately constant.

Because πD/360 is a common term in each of the three path lengths (L1, L2, L3), the exposure of each carbon felt strip 14, 32, 31 to compounds leached from the liner 13 is thus expected to be proportional to the respective contact path lengths L1, L2, L3 past the liner 13. The total leachate adsorbed, designated Q, by the three carbon felts 14, 32, 31 accordingly is the sum of the three adsorptions of the felt strips collectively. Accordingly, total leachate adsorbed, Q, is given by $$Q=R(L1+L2+L3)=R(T1+T2+T3)\pi D/360$$

where R is the leaching rate from the liner, per unit length, times the circumference increment/360. As suggested in FIG. 3, the three carbon felt strips 14, 32, 31 preferably are equally spaced at 120 degrees apart. Hence T1 equals 120 degrees minus T. And T2 equals T, while T3 equals 120 degrees. Notably, the angular sum of the flow paths to the several felt strip adsorbers 14, 32, 31 is 240 degrees regardless of the magnitude of angle T between the point where the original lateral flow 33 contacts the liner and the point of the reference datum 0. The felt strips 14, 31, 32 collect different amounts of leached toluene, the amount adsorbed by a given felt strip depending upon where the lateral flow vector 33 strikes the lined borehole. Ideally, the lateral flow is divided to discharge equally around the lined borehole in the fracture.

Figure 4:
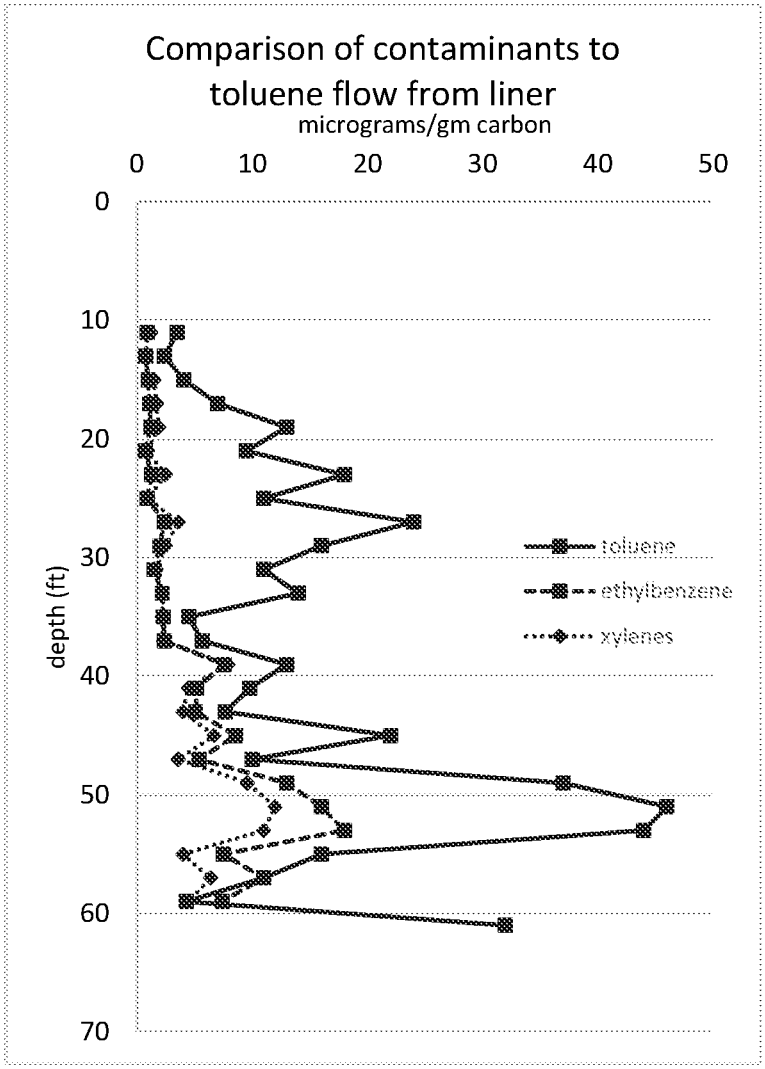
FIG. 4 is a graph, of contaminant concentrations as a function of depth in a borehole, of contaminants and toluene leachates collected in an activated carbon strip on a liner system according to the present invention.

If all three carbon felt strips are combined and analyzed for a single contaminant sample over a specific vertical interval in the borehole 11, the total adsorption is the same independent of the azimuthal location of the original lateral flow vector 33. The net result is that, if a lateral fracture flow is leaching a substance (e.g., toluene) from the liner 13 at a constant rate as the water flows past the liner, the quantity of leachate is expected to be approximately indicative of the volume of flow past the liner 13. Consequently, liner leachate serves, in the system and method, as an effective tracer substance for gauging fluid flow from a formation fracture and to and around a lined borehole. The area of exposure to the liner 13 and to the carbon felt strips 14, 31, 32 is proportional to the opening width of the fracture and the flow velocity. The larger the opening, the greater the exposure. The faster the flow, the more tracer substance can be carried to the carbon felt strips per unit time, and because the carbon integrates in time the flow of tracer substance and also the flow of contaminants in the impinging flow 33, the total quantity of tracer substance in the combined carbon strips 14, 31, 32 should be proportional to the total volume fluid flow past the sealed borehole. FIG. 4, graphing the ratio of ambient contaminants to tracer substance (toluene) as a function of borehole depth, depicts results that were obtained with only a single carbon felt strip. The correlation of mass of adsorbed ambient contaminants to mass of adsorbed toluene is evident.

After the liner 13 and associated carbon felt strips 14, 31, 32 have remained in the borehole for the designated period of time, they are retrieved from the borehole by inversion (turning the liner "outside in"), as known from my previous patents. The carbon strips 14, 31, 32 of the liner brought to the surface are then analyzed to measure contaminants, and particularly liner leachate(s) (tracer substances), adsorbed therein. From the quantity of leachate extracted from each respective carbon strip 14, 31, or 32, the volume flow past the respective carbon strip can be determined, and from that information the general direction of fracture flow may be surmised; "upstream" carbon felt strips will tend to adsorb a larger amount of leachate than relatively "downstream" strips.

A somewhat unexpected correlation is that when the contaminate adsorbed in the carbon is ambient to the surrounding formation (i.e., is not leachate from the liner), the peaks in vertical plots of some ambient contaminants adsorbed in the carbon felt strip are nevertheless associated with peaks in the liner leachate adsorbed. As mentioned previously, the data plotted in FIG. 4 is an example of how the ambient contaminants ethylbenzene and xylenes in the formation water peak at the same location as the liner leachate (tracer substance) adsorbed in the carbon at various elevations (depths) in the borehole.

If the three carbon strips 14, 31, 32 are not used—i.e., in known systems using only one carbon felt strip—the contaminant level adsorbed into the carbon of a single felt strip can depend heavily on the direction of the original lateral flow 33 encountering the lined borehole. If first and third carbon strips 14 and 31 (positions 1 and 3) were absent, the leachate adsorbed would depend on flow path length L2, which is entirely dependent on the initial angle T. For instance, if the magnitude of angle T (and thus angle T2) is relatively small, there may not be any significant leachate collected in the second felt strip 32 at position 2 of FIG. 3. While not a precise indicator, the leachate concentration can identify active fractures without any contamination in the flow past the borehole at the elevation of the fracture. These identified flow paths should be a subset of the fracture flows mapped using the method of my U.S. Pat. No. 6,910,374. It is convenient that the same liner used to install the carbon strips is used to map the fracture distribution and flow capacity in the formation.

However, and significantly, unless three equally spaced carbon strips (14, 31, 32) are used, the total leachate (i.e., tracer substance) adsorption can vary tremendously with the direction of flow at different fractures and with different values of the impingement angle T. Advantageously, according to the present methodology and system with three absorbers, the total adsorption of leachate may be a relative measure of the flow volume past the carbon felt strips, because the carbon integrates across the full fracture width according to the rate the leachate is carried to the carbon.

This method suggests the three segments over an interval be analyzed together for reduced sampling cost. However, if the orientation of the carbon strips is known (e.g., a camera scan of the interior of the in situ liner), analyzing the carbon sections separately may provide evidence of the direction of the flow based on the distribution of the adsorbed leachate in each carbon strip.

It is noteworthy that the original lateral flow vector 33 in the fracture, as depicted in FIG. 3, reaches the liner 13 between the two carbon felt strip adsorbers 14 and 32 with resulting lower levels of leachate than expected in the analysis of the third carbon felt strip adsorber 31. The reason is that, in the example, flow path lengths L1 and L2 are shorter absolute total leaching lengths than is length L3. In FIG. 3, the felt strips at positions 1 and 2 would adsorb less leachate than the felt strip at position 3 because of the relative lengths L1, L2 and L3 seen in the figure. In the ideal flow geometry, the suspected location of the original lateral flow vector 33 depends on the relative values of leachate in the first and second felt strips 13 and 32.

So, if the angle T is, by chance, at 60 degrees, the adsorption at the third felt strip 31 (at position 3) could be the sum of the flows past both sides of the liner 13, as the vector 33 impinges a point diametrically opposite from position 3. However, such a circumstance requires a perfect match of the flow past each side of the liner, and the downstream flow 34 is precisely centered on the third carbon felt strip 31. Were that the special case, the leachate would be enhanced by 33% in the third felt strip 31, assuming the total departing flow 34 was exposed to the third felt strip.

The method is evident from the foregoing, put a preferred process according to the present disclosure is now offered. The method is for detecting and measuring fluid flow in fractures in a subsurface geological formation, and includes basic steps of providing a tubular flexible liner 13 having a tracer substance impregnated therein; spacing apart radially a plurality of tracer detection strips 14, 31, 32 upon the liner 13 and along at least a portion of the liner length; everting the liner into a borehole 11 in the geological formation 12 to place the plurality of tracer detection strips adjacent to the formation; allowing fluid to flow from a fracture in the formation 12 to and around the liner 13 and into contact with at least two of the tracer detection strips 14, 31, 32; permitting the tracer substance to leach from the liner 13 into the flowing fluid; allowing the tracer substance to adsorb from the flowing fluid and into the at least two tracer detection strips; withdrawing the liner 13 from the borehole 11; and measuring a total quantity of tracer substance adsorbed by all the tracer detection strips 14, 31, 32. The preferred method further features the step of estimating, from the total quantity of tracer substance adsorbed, a volume of fluid flow from the fracture past the liner 13. The tracer substance preferably, but not necessarily, is toluene impregnated in the composition of the liner 13 at the time of liner fabrication. "Spacing apart radially a plurality of tracer detection strips" preferably includes a step of radially spacing three detection strips 14, 31, 32 by 120 degrees between strips. The plurality of tracer detection strips 14, 31, 32 ordinarily are carbon felt strips attached upon the liner 13. "Withdrawing the liner from the borehole" preferably means inverting the liner, so to retrieve it from the borehole 11.

The preferred method includes allowing the tracer substance to adsorb from the flowing fluid and into at least two, preferably three tracer detection strips 14, 31, 32; so doing may include allowing each of at least two tracer detection strips 14, 31, 32 to adsorb tracer substance in proportion to the amount of tracer substance leached from the liner 13 and into the flowing fluid. "Allowing the tracer substance to adsorb from the flowing fluid and into the at least two tracer detection strips" preferably further contemplates the step of allowing each of at least two tracer detection strips 14, 31, 32 to adsorb a respective volume of tracer substance independently of each strip's radial location upon the liner 13, and independently of a direction of the fluid flow from the fracture in the formation 12. A preferred mode of the invention than can include the further steps of determining the respective volume of tracer substance absorbed separately by each of the at least two tracer detection strips 14, 31, 32, and from the respective volumes of tracer substance absorbed separately by the detection strips, approximating a direction of fluid flow in the fracture of the formation.

Accordingly, an objective enabled by the system and method is to identify those fractures that are actively flowing by measurement of the relative level of the tracer substance such as toluene. The higher the level of contaminant in the water, the more is passing. That does not depend on the tracer substance level, which only identifies flow. High tracer substances will identify flow in uncontaminated fractures. It may be useful to compare transmissivity profile results derived by the methods of, for example, U.S. Pat. Nos. 6,910,374 and 7,281,422, which measure flow rates possible but not necessarily actual flow.

In summary, this present invention allows the common tracer substance, toluene, in coated liner fabrics to assist in assessing the active fractures in a set of subsurface formation fractures (some of which may not be flowing) mapped with the method of U.S. Pat. No. 7,281,422. Because it is frequently seen with the method of U.S. Pat. No. 7,896,578 that liner toluene peaks occur congruently or correspondingly with contaminant peaks of ambient contaminants in the flowing fractures, this method is indicative of fracture flows even where ambient contaminants are not present. (Further tests and refinements may allow the better resolution of the direction of the original lateral flow vector 33.)

A leading advantage justified by the additional cost of adding two additional carbon felt strips to the cover 22 is the far higher cost, by comparison, of other methods now in use which only determine the active fractures in a borehole with no measure of actual flow capacity.

U.S. Patents cited hereinabove are incorporated herein at their respective points of citation.

Although the invention has been described in detail with particular reference to these preferred embodiments, other embodiments may achieve the same results. In the previous description, specific details are set forth, such as specific materials, structures, chemicals, processes, etc., in order to provide a thorough understanding of the present invention. However, as one having ordinary skill in the art would recognize, the present invention can be practiced without resorting to the details specifically set forth. In other instances, well known principles of mechanics, geohydrology, and physics have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover with the appended claims all such modifications and equivalents.

What is claimed is:

1. A method comprising:

providing a liner having a tracer substance impregnated therein;

spacing apart radially a plurality of tracer detection strips upon the liner and along at least a portion of the liner length;

everting the liner into a borehole in a geologic formation to place the plurality of tracer detection strips adjacent to the geologic formation;

allowing fluid to flow from a fracture in the geologic formation to and around the liner and into contact with two of the tracer detection strips;

permitting the tracer substance to leach from the liner into the flowing fluid;

allowing the tracer substance to adsorb from the flowing fluid and into the two tracer detection strips;

withdrawing the liner from the borehole; and measuring a total quantity of tracer substance adsorbed by all the tracer detection strips.

2. The method according to claim 1, further comprising the step of estimating, from the total quantity of tracer substance adsorbed, a volume of fluid flow from the fracture past the liner.

3. The method according to claim 1 wherein providing a liner comprises the step of providing a liner having toluene therein.

4. The method according to claim 1 wherein spacing apart radially a plurality of tracer detection strips comprises the step of radially spacing three tracer detection strips by 120 degrees between detection strips.

5. The method according to claim 4 wherein radially spacing three tracer detection strips comprises the step of attaching carbon felt strips upon the liner.

6. The method according to claim 1 wherein withdrawing the liner from the borehole comprises the step of inverting the liner.

7. The method according to claim 1 wherein allowing the tracer substance to adsorb from the flowing fluid and into the two tracer detection strips comprises the step of allowing each of the two tracer detection strips to adsorb tracer substance in proportion to the amount of tracer substance leached from the liner and into the flowing fluid.

8. The method according to claim 7 wherein allowing the tracer substance to adsorb from the flowing fluid and into the two tracer detection strips further comprises the step of allowing each of the two tracer detection strips to adsorb a respective volume of tracer substance independently of each strip's radial location upon the liner, and independently of a direction of the fluid flow from the fracture in the geologic formation.

9. The method according to claim 8 comprising the further steps of:

determining the respective volume of tracer substance absorbed separately by each of the two tracer detection strips; and from the respective volumes of tracer substance absorbed separately by the two tracer detection strips, approximating a direction of fluid flow in the fracture in the geologic formation.

10. A method for detecting and measuring fluid flow in fractures in a geologic formation, comprising:

providing a liner having a tracer substance impregnated therein;

spacing apart radially a plurality of tracer detection strips upon the liner and along at least a portion of the liner length;

everting the liner into a borehole in the geologic formation to place the plurality of tracer detection strips adjacent to the geologic formation;

allowing fluid to flow from a fracture in the geologic formation to and around the liner and into contact with the plurality of tracer detection strips;

intentionally permitting the tracer substance to leach from the liner into the flowing fluid;

intentionally allowing the tracer substance to adsorb from the flowing fluid and into the plurality of tracer detection strips;

measuring a total quantity of tracer substance adsorbed by all the tracer detection strips; and estimating, from the total quantity of tracer substance adsorbed, a volume of fluid flow from the fracture past the liner.

11. The method according to claim 10 wherein spacing apart radially a plurality of tracer detection strips comprises the step of radially spacing three carbon felt strips by 120 degrees.

12. The method according to claim 10 wherein allowing the tracer substance to adsorb from the flowing fluid and into the plurality of tracer detection strips comprises the step of allowing each of two or three tracer detection strips to adsorb tracer substance in proportion to the amount of tracer substance leached from the liner and into the flowing fluid.

13. The method according to claim 12 wherein allowing each of the two or three tracer detection strips to adsorb tracer substance further comprises the step of allowing each of the two or three tracer detection strips to adsorb a respective volume of tracer substance independently of each detection strip's radial location upon the liner, and independently of a direction of the fluid flow from the fracture in the geologic formation.

14. The method according to claim 13 comprising the further steps of:

determining the respective volume of tracer substance absorbed separately by each of the two or three tracer detection strips; and from the respective volumes of tracer substance absorbed separately by the detection strips, approximating a direction of fluid flow in the fracture in the geologic formation.

* * * * *